US011624545B2

(12) United States Patent
Park et al.

(10) Patent No.: US 11,624,545 B2
(45) Date of Patent: Apr. 11, 2023

(54) REFRIGERATOR HAVING REMOVABLE COOLING MODULE

(71) Applicant: SAMSUNG ELECTRONICS CO., LTD., Suwon-si (KR)

(72) Inventors: Sung Jin Park, Suwon-si (KR); Dong Won Koo, Suwon-si (KR); In Yong Hwang, Suwon-si (KR); Youn Tae Shin, Suwon-si (KR); Dong Hyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 163 days.

(21) Appl. No.: 16/721,040

(22) Filed: Dec. 19, 2019

(65) Prior Publication Data

US 2020/0200467 A1 Jun. 25, 2020

(30) Foreign Application Priority Data

Dec. 19, 2018 (KR) ..... 10-2018-0165583

(51) Int. Cl.

| | |
|---|---|
| ***F25D 17/08*** | (2006.01) |
| ***F25D 23/00*** | (2006.01) |
| ***F25D 23/12*** | (2006.01) |
| ***F25D 27/00*** | (2006.01) |
| ***F25D 29/00*** | (2006.01) |
| ***F25D 11/02*** | (2006.01) |

(52) U.S. Cl.

CPC ..... *F25D 23/006* (2013.01); *F25D 11/022* (2013.01); *F25D 23/003* (2013.01); *F25D 23/126* (2013.01); *F25D 27/00* (2013.01); *F25D 29/005* (2013.01); *F25D 2323/0028* (2013.01); *F25D 2400/36* (2013.01); *F25D 2400/40* (2013.01); *F25D 2700/10* (2013.01)

(58) Field of Classification Search

CPC .... F25D 23/003; F25D 23/006; F25D 29/005; F25D 2400/40; F25D 2700/10

See application file for complete search history.

(56) References Cited

U.S. PATENT DOCUMENTS

| | | | | |
|---|---|---|---|---|
| 3,712,078 | A | 1/1973 | Maynard et al. | |
| 5,199,273 | A | 4/1993 | Silva et al. | |
| 5,953,929 | A | 9/1999 | Bauman et al. | |
| 6,070,424 | A * | 6/2000 | Bauman | F25D 19/00 62/279 |
| 6,094,934 | A | 8/2000 | Rand et al. | |
| 6,438,988 | B1 | 8/2002 | Paskey | |

(Continued)

FOREIGN PATENT DOCUMENTS

| | | |
|---|---|---|
| CN | 101113861 | 1/2008 |
| CN | 107388703 A | 11/2017 |

(Continued)

OTHER PUBLICATIONS

KR 2003-0027367 (English Translation) (Year: 2003).*

(Continued)

*Primary Examiner* — Jonathan Bradford

(74) *Attorney, Agent, or Firm* — Staas & Halsey LLP

(57) ABSTRACT

A refrigerator includes a cabinet, a cooling module including a compressor, a condenser, an expansion valve, and an evaporator, and attachable to or detachable from the cabinet so that the cooling module is removably mounted to the cabinet, an electronic device arranged in the cabinet, and an electrical box configured to be electrically connected to the electronic device and the compressor, receive power from outside and supply the received power to the electronic device and the compressor.

20 Claims, 12 Drawing Sheets

(56) References Cited

U.S. PATENT DOCUMENTS

| | | | | |
|---|---|---|---|---|
| 2003/0230104 | A1* | 12/2003 | Morse | F25D 19/00 62/277 |
| 2008/0156034 | A1* | 7/2008 | Cur | F25D 11/02 62/449 |
| 2011/0302939 | A1* | 12/2011 | Rockenfeller | F25B 49/02 62/89 |
| 2012/0043986 | A1* | 2/2012 | Richter | H02G 3/16 324/756.01 |
| 2013/0305770 | A1 | 11/2013 | Grewal et al. | |
| 2016/0123649 | A1* | 5/2016 | Ahn | F25D 21/08 62/155 |
| 2018/0335242 | A1* | 11/2018 | Besore | F25D 11/022 |

FOREIGN PATENT DOCUMENTS

| | | | |
|---|---|---|---|
| CN | 107588590 | A | 1/2018 |
| DE | 10 2004 052 621 | A1 | 5/2006 |
| EP | 2 664 876 | A2 | 11/2013 |
| JP | 7-294097 | A | 11/1995 |
| JP | 2004-358017 | | 12/2004 |
| JP | 4033805 | | 1/2008 |
| KR | 20030027367 | A * | 4/2003 |
| KR | 10-2007-0096025 | | 10/2007 |
| KR | 10-2011-0029135 | | 3/2011 |
| KR | 10-2016-0006346 | | 1/2016 |

OTHER PUBLICATIONS

International Search Report dated Mar. 24, 2020 in International Patent Application No. PCT/KR2019/016543.

Supplementary European Search Report dated Oct. 29, 2021 in European Application No. 19 90 0745.

Chinese Office Action dated Aug. 3, 2022 issued in Chinese Application No. 201980085185.1.

Office Action dated Jan. 18, 2023 issued in Chinese Application No. 201980085185.1.

* cited by examiner

REFRIGERATOR HAVING REMOVABLE COOLING MODULE

CROSS-REFERENCE TO RELATED APPLICATION(S

This application is based on and claims priority under 35 U.S.C. § 119 to Korean Patent Application No. 10-2018-0165583, filed on Dec. 19, 2018, in the Korean Intellectual Property Office, the disclosure of which is incorporated by reference herein in its entirety.

BACKGROUND

1. Field

The disclosure relate to a refrigerator, and more particularly, to a refrigerator including a cold air supply system having an improved structure.

2. Description of the Related Art

A refrigerator is an apparatus configured to keep foods fresh by including a main body having a storage compartment, and a cold air supply system configured to supply cold air to the storage compartment. The storage compartment includes a refrigerating compartment maintained at about 0 to 5° C. for storing foods at a refrigerating state and a freezing compartment maintained at about −30 to 0° C. for storing foods at a freezing state.

In the refrigerator, an insulating material is provided in a cabinet forming the storage compartment, and a machine room is formed outside the cabinet. Among components constituting the cold air supply system, a compressor and an condenser are arranged in the machine room formed outside the cabinet, an evaporator is arranged in the storage compartment formed inside the cabinet, and a refrigerant pipe through which the refrigerant moves is arranged to penetrate the insulating material.

Accordingly, when testing the cooling performance of the cold air supply system of the refrigerator, it is required that all the components of the cold air supply system are installed in the cabinet. Further, when maintaining and repairing the cold air supply system, it is required to disassemble the cabinet.

SUMMARY

Therefore, it is an aspect of the disclosure to provide a refrigerator capable of improving the manufacturing process.

It is another aspect of the disclosure to provide a refrigerator capable of reducing the loss in the manufacturing process and capable of improving productivity.

Additional aspects of the disclosure will be set forth in part in the description which follows and, in part, will be apparent from the description, or may be learned by practice of the disclosure.

In accordance with an aspect of the disclosure, a refrigerator includes a cabinet, a cooling module including a compressor, a condenser, an expansion valve, and an evaporator, and attachable to or detachable from the cabinet so that the cooling module is removably mounted to the cabinet, an electronic device arranged in the cabinet, and an electrical box configured to be electrically connected to the electronic device and the compressor, receive power from outside and supply the received power to the electronic device and the compressor.

The electrical box may be arranged in the cooling module, and the cooling module may include a module body including an electrical box mounting portion to which the electrical box is mounted.

The module body may include a receiving portion in which the evaporator is arranged, and a receiving portion opening formed therein and configured to guide a first wire extending to the receiving portion.

A module insulating material may be provided inside the module body, and the first wire may be arranged so that a portion of the first wire passes through the module insulating material.

The cooling module may include a duct module arranged in the receiving portion, and the first wire may electrically connect the duct module to the electrical box.

The module body may include a machine room, in which the compressor and the condenser are arranged, and a machine room opening formed therein and configured to guide a second wire extending to the machine room.

A module insulating material may be provided inside the module body, and the second wire may be arranged so that a portion of the second wire passes through the module insulating material.

The cooling module may include a cooling fan configured to cool the machine room, and the second wire may electrically connect the cooling fan to the electrical box.

The electronic device may include at least one of a dispenser, an ice maker, a display apparatus, and an interior light.

The cabinet may include an electrical box heat dissipation opening formed therein and configured to allow the electrical box to be exposed to the outside to dissipate the heat of the electrical box.

The module body may include a connector receiving space formed to receive connectors provided in a plurality of wires extending from the electrical box.

The electrical box may include a test connector exposed to the outside.

The electrical box may include a power board configured to receive power from the outside and transmit the power to the electronic device and the compressor, and a control board configured to control the electronic device and the compressor by receiving power from the power board.

The cooling module may include a temperature sensor configured to measure a temperature of cold air generated by the evaporator.

The electrical box may be arranged in the cabinet.

In accordance with another aspect of the disclosure, a refrigerator includes a cabinet, a cooling module including a compressor, a condenser, an expansion valve, an evaporator, and an electrical box and attachable to or detachable from the cabinet so that the cooling module is removably mounted to the outside of the cabinet, and an electronic device arranged in the cabinet, and the electrical box is electrically connected to the electronic device and includes a power board configured to receive power from the outside and transmit the power to the electronic device and the compressor.

The cooling module may include a module body, and the module body may include an electrical box mounting portion to which the electrical box is mounted, a receiving portion in which the evaporator is arranged, and a machine room in which the compressor and the condenser are arranged.

The module body may include a receiving portion opening formed therein and configured to guide a first wire extending to the receiving portion, and a machine room opening configured to guide a second wire extending to the machine room.

A module insulating material may be provided inside the module body, and the first wire may be arranged in such a way that a portion of the first wire passes through the module insulating material, and the second wire may be arranged so that a portion of the second wire passes through the module insulating material.

The cooling module may include a test connector configured to electrically connect an external test device to the electrical box, and exposed to the outside of the cooling module, and a temperature sensor configured to measure a temperature of cold air generated by the evaporator and configured to transmit information on the measured temperature to the electrical box.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
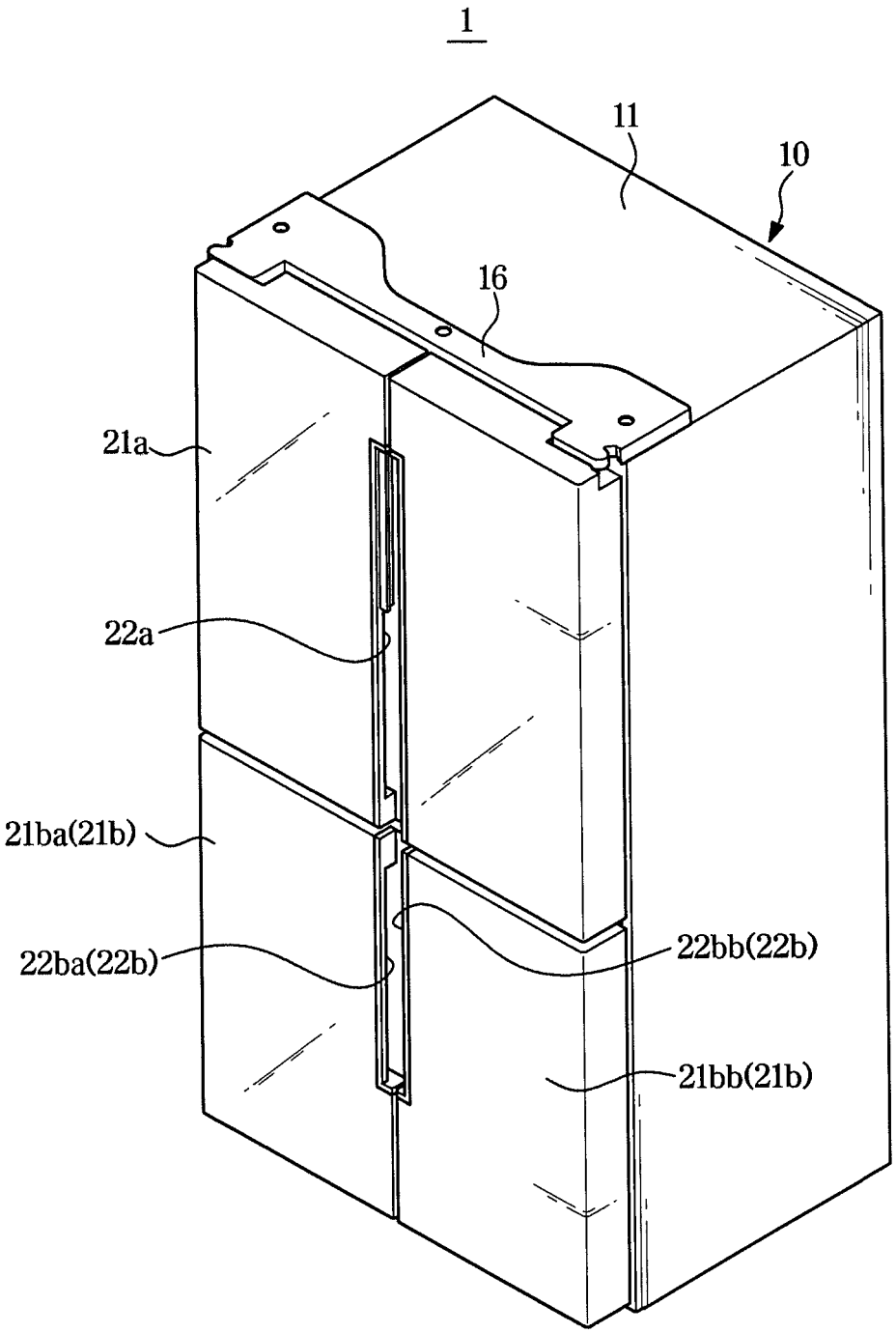
FIG. 1 is a view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "upper portion", "lower portion", and the like may be defined by the drawings, but the shape and the location of the component is not limited by the term.

The disclosure will be described more fully hereinafter with reference to the accompanying drawings.

Figure 2:
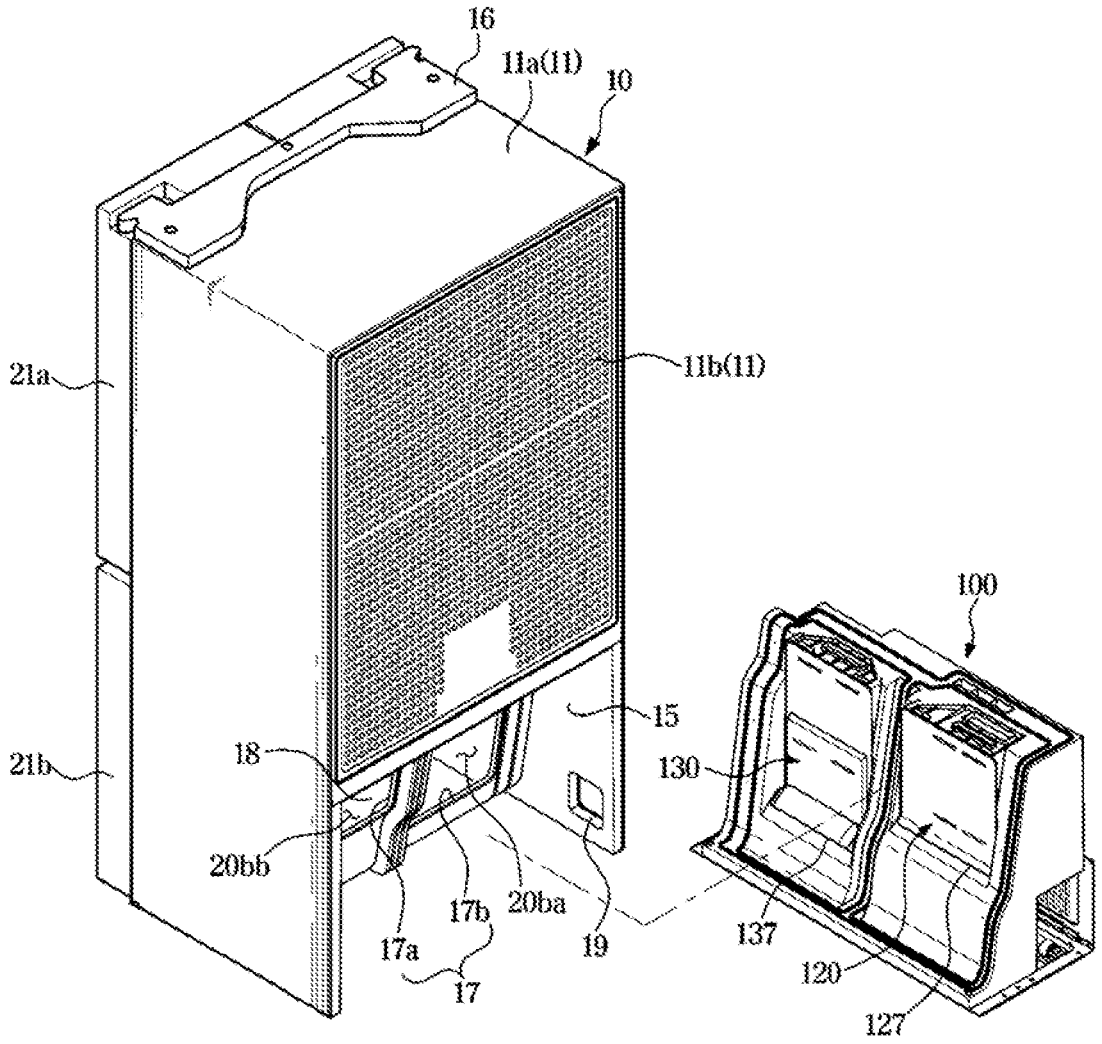
FIG. 2 is a view illustrating a state in which a cooling module is separated from a cabinet of the refrigerator shown in FIG. 1.
Figure 3:
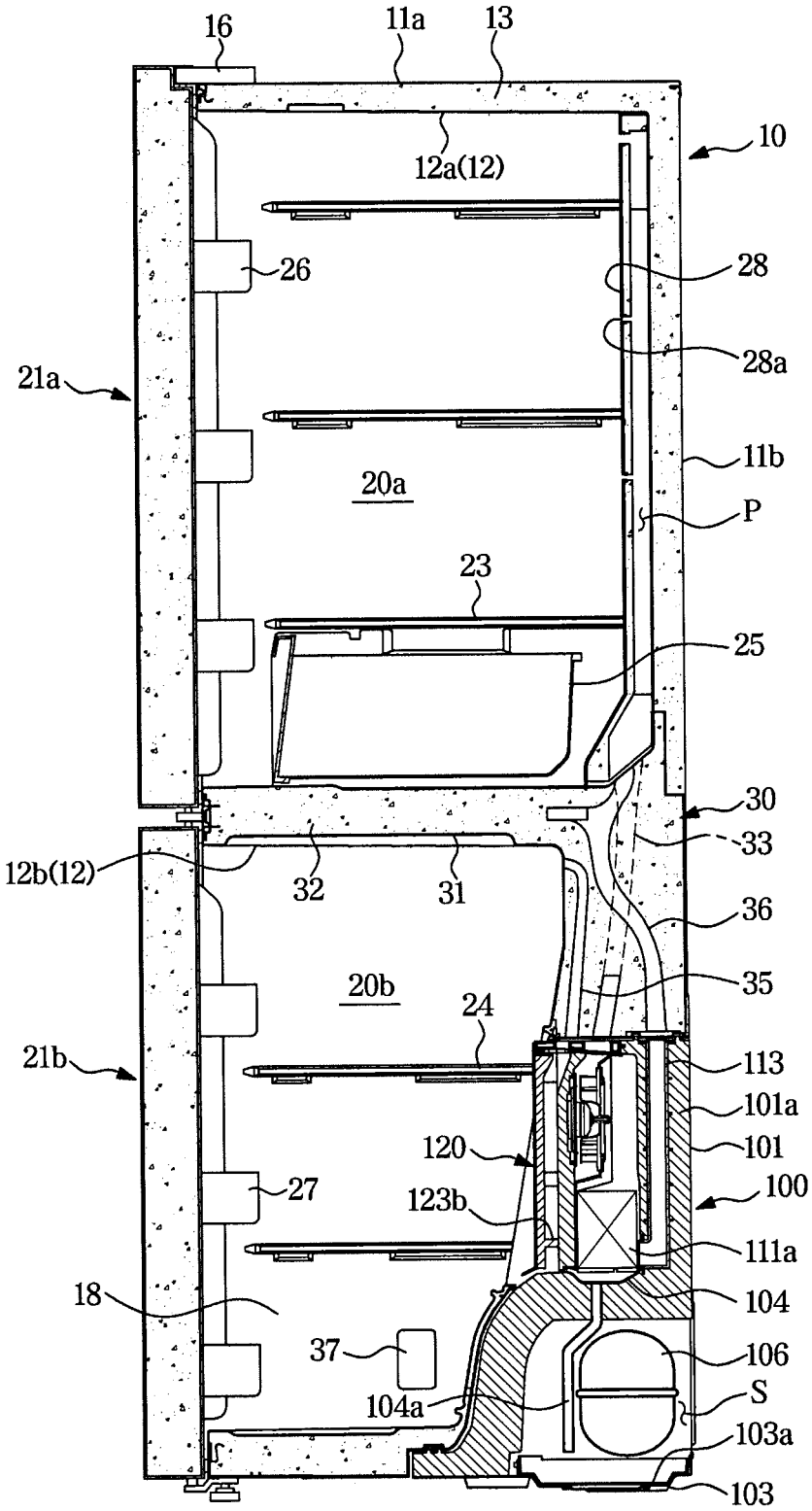
FIG. 3 is a cross-sectional view of the refrigerator shown in FIG. 1.

FIG. 1 is a view of a refrigerator according to an embodiment of the disclosure. FIG. 2 is a view illustrating a state in which a cooling module is separated from a cabinet of the refrigerator shown in FIG. 1. FIG. 3 is a cross-sectional view of the refrigerator shown in FIG. 1.

Referring to FIGS. 1 to 3, a refrigerator 1 may include a cabinet 10 forming storage compartments 20*a* and 20*b*, doors 21*a* and 21*b* configured to open and close the storage compartments 20*a* and 20*b*, and a cooling module 100 is attachable to or detachable from the cabinet 10 so that the cooling module is removably coupled to the cabinet 10 and configured to supply cold air to the storage compartments 20*a* and 20*b*.

The cabinet 10 may include an outer case 11 and an inner case 12 coupled to the inside of the outer case 11. The outer case 11 may include a cabinet body 11*a* in which front and rear surfaces are opened, and a cabinet cover 11*b* covering a rear surface of the cabinet body 11*a*. The front surface of the cabinet body 11*a* may be covered by the doors 21*a* and 21*b*. The outer case 11 may be formed of a metal material.

The inner case 12 may form the storage compartments 20*a* and 20*b*. The inner case 12 may be formed by injecting a plastic material. The inner case 12 may include a first inner case 12*a* forming an upper storage compartment 20*a* and a second inner case 12*b* forming a lower storage compartment 20*b*.

A cabinet insulating material 13 may be provided between the outer case 11 and the inner case 12. The cabinet insulating material 13 may be formed of urethane foam insulation or alternatively, the cabinet insulating material 13 may be formed of a vacuum insulation panel together with urethane foam insulation, as needed.

The cabinet 10 may include an intermediate body 30 arranged between the first inner case 12*a* and the second inner case 12*b*. The intermediate body 30 may include a partition 31 configured to divide the storage compartment 20*a* and 20*b* into the upper compartment 20*a* and the lower compartment 20*b*. The intermediate body 30 may include an intermediate insulating material 32 to prevent heat exchange between the upper storage compartment 20*a* and the lower storage compartment 20*b*. The intermediate insulating material 32 may be provided to prevent the loss of cold air to the outside at a portion of the rear of the lower storage compartment 20*b*.

In the intermediate body 30, a first cold air duct 33, a second cold air duct (not shown), a third cold air duct 35, and a first circulation duct 36 may be arranged. The first cold air duct 33, the second cold air duct, the third cold air duct 35, and the first circulation duct 36 may be arranged to penetrate the intermediate insulating material 32.

The first cold air duct 33 may guide cold air, which is generated in the first evaporator 111*a*, to the first storage compartment 20*a*. The second cold air duct may guide cold air, which is generated in the second evaporator 111*b*, to a second storage compartment 20*ba*. The third cold air duct 35 may guide cold air, which is generated in the second evaporator 111*b*, to a third storage compartment 20*bb*. The first circulation duct 36 may guide air, which has cooled the first storage compartment 20*a*, to the first evaporator 111*a*.

The storage compartments 20*a* and 20*b* may be formed in such a way that the front surface of the storage compartments 20*a* and 20*b* opens to allow foods to be inserted into or taken out therefrom. The storage compartments 20*a* and 20*b* may include the upper storage compartment 20*a* and the lower storage compartment 20*b*. The upper storage compartment 20*a* may be maintained at approximately 0 to 5° C. and may be used as a refrigerating compartment for storing food at a refrigerating state. The upper storage compartment 20*a* may be referred to as the first storage compartment 20*a*.

Referring to FIG. 3, in the first storage compartment 20*a*, a guide cover 28 configured to distribute cold air supplied from the first cold air duct 33 may be arranged. Together with the first inner case 12*a*, the guide cover 28 may form a flow path P, through which cold air received from the first cold air duct 33 flows.

The guide cover 28 may include a guide hole 28*a* supplying the cold air received from the first cold air duct 33 to the first storage compartment 20*a*. The guide holes 28*a* may be provided in plural in the vertical direction.

The lower storage compartment 20*b* may include the second storage compartment 20*ba* and the third storage compartment 20*bb*. The cabinet 10 may include a separation plate 18 configured to separate the second storage compartment 20*ba* from the third storage compartment 20*bb*. The second storage compartment 20*ba* may be maintained at about −30 to 0° C. and may be used as a freezing compartment for storing food at a freezing state. The third storage compartment 20*bb* may be used as a temperature variable compartment configured to vary the temperature. However, the use of the first storage compartment 20*a*, the second storage compartment 20*ba*, and the third storage compartment 20*bb* may be changed.

Open front surfaces of the storage compartments 20*a* and 20*b* may be opened and closed by the doors 21*a* and 21*b*. The storage compartments 20*a* and 20*b* may be provided with shelves 23 and 24 on which food is placed, and storage containers 25 storing food.

The upper door 21*a* may be configured to open and close the first storage compartment 20*a*. The upper door 21*a* may be coupled to the cabinet 10 to be rotatable in the left and right directions. An upper door guard 26 storing food may be provided on the rear surface of the upper door 21*a*. A hinge cover 16 may be provided at a portion of the cabinet 10 to which the upper door 21*a* is coupled. The upper door 21*a* may be referred to as a first door 21*a*.

The first door 21*a* may include a first door handle 22*a*. A user may open and close the first door 21*a* by holding the first door handle 22*a*.

The lower door 21*b* may be configured to open and close the lower storage compartment 20*b*. The lower door 21*b* may be coupled to the cabinet 10 to be rotatable in the left and right directions. A lower door guard 27 storing food may be provided on the rear surface of the lower door 22. The lower door 21*b* may include a second door 21*ba* opening and closing the second storage compartment 20*ba* and a third door 21*bb* opening and closing the third storage compartment 20*bb*.

The lower door 21*b* may include a lower door handle 22*b*. A user can open and close the lower door 21*b* by holding the lower door handle 22*b*. Particularly, the second door 21*ba* may include a second door handle 22*ba*, and the third door 21*bb* may include a third door handle 22*bb*.

In a lower portion of the cabinet 10, a cooling module mounting portion 15, which the cooling module 100 is attachable to or detachable from thereby removably mounted in, may be provided. The cooling module mounting portion 15 may be provided in a size and shape corresponding to the cooling module 100.

The cabinet 10 may include a duct opening 17. The duct opening 17 may be formed in the cooling module mounting portion 15. The duct opening 17 may be arranged in a portion of the cabinet 10 facing the cooling module 100. The duct opening 17 may include a first duct opening 17*b* configured to allow the cooling module mounting portion 15 to communicate with the second storage compartment 20*ba*, and a second duct opening 17*a* configured to allow the cooling module mounting portion 15 to communicate with the third storage compartment 20*bb*.

Figure 4:
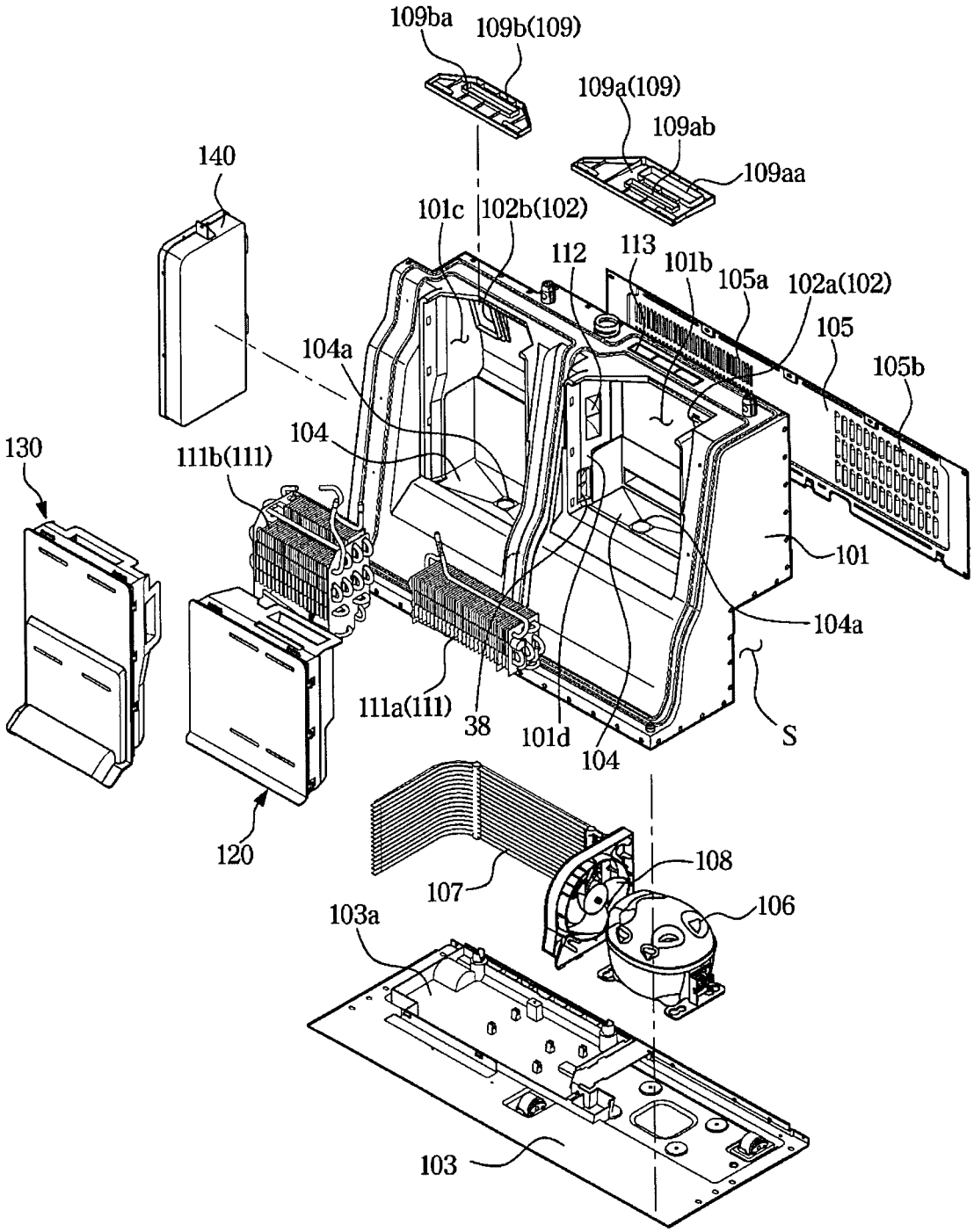
FIG. 4 is an exploded view of the cooling module shown in FIG. 2.
Figure 5:
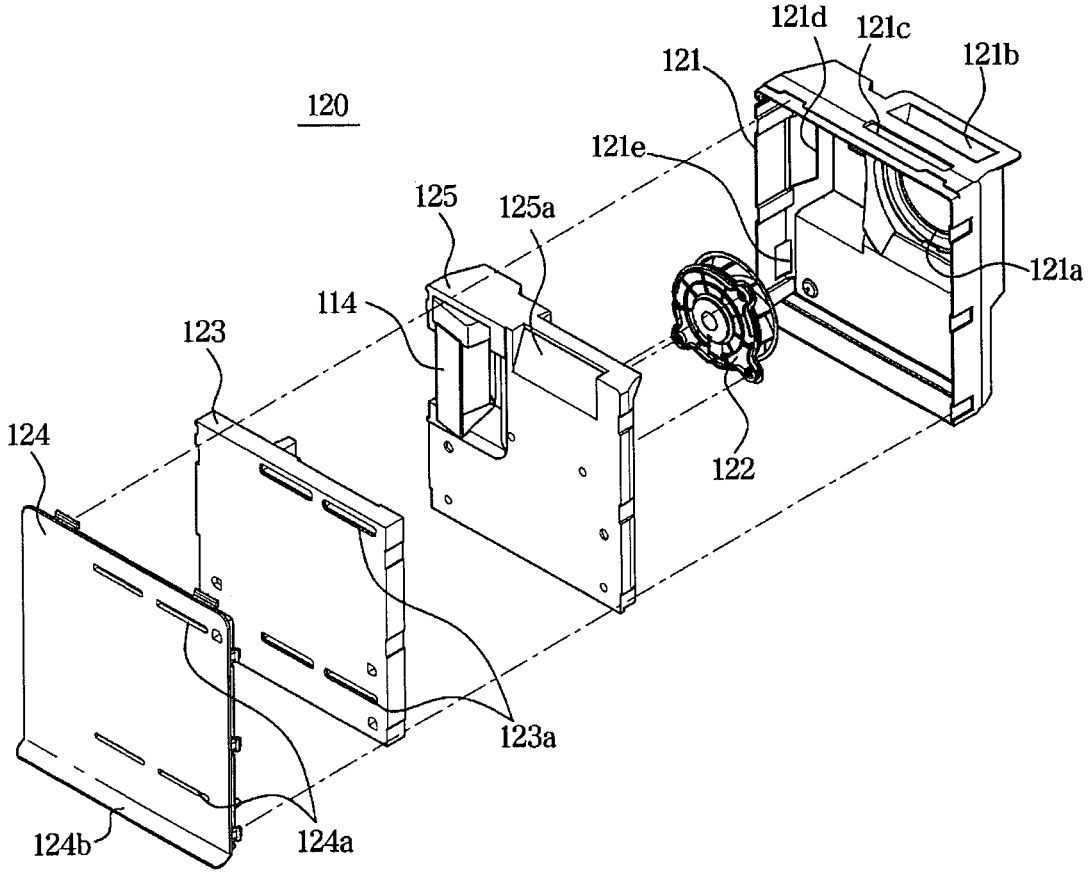
FIG. 5 is an exploded view of a first duct module shown in FIG. 4.
Figure 6:
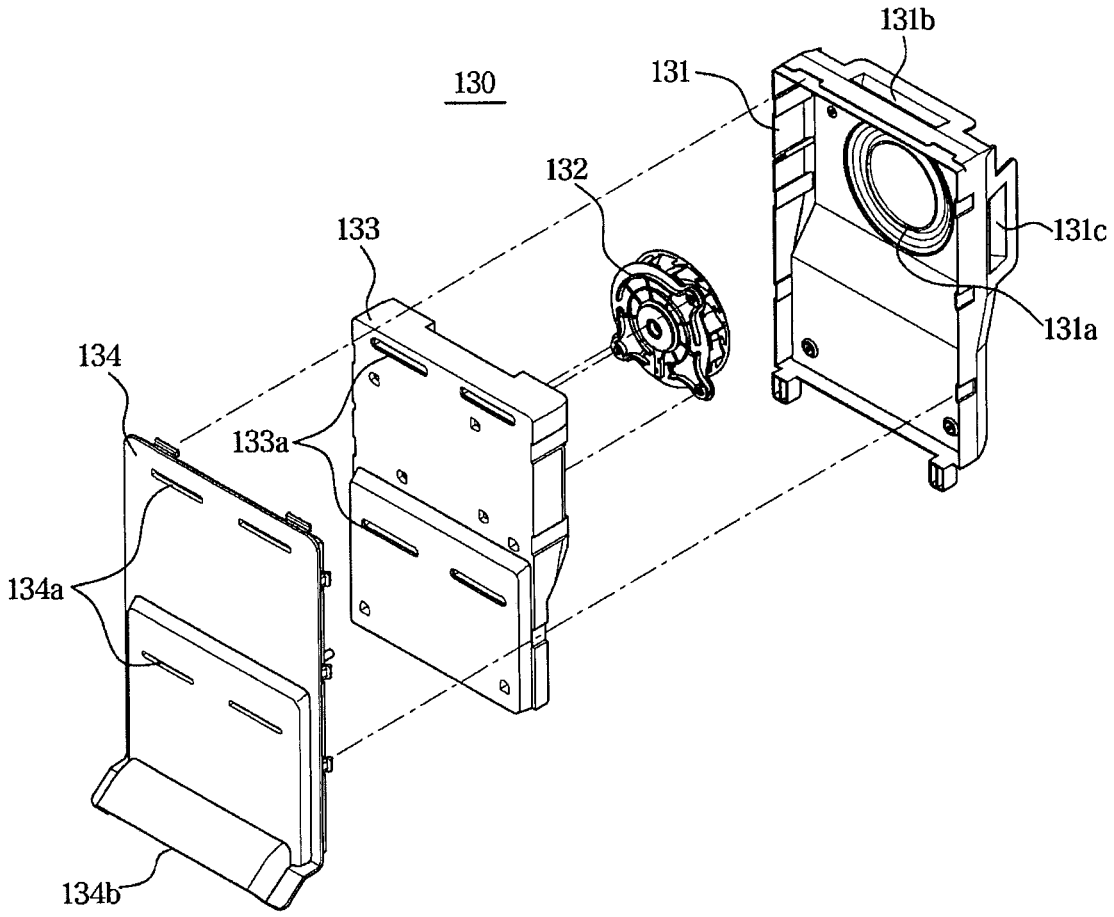
FIG. 6 is an exploded view of a second duct module shown in FIG. 4.

FIG. 4 is an exploded view of the cooling module shown in FIG. 2. FIG. 5 is an exploded view of a first duct module shown in FIG. 4. FIG. 6 is an exploded view of a second duct module shown in FIG. 4.

The cooling module 100 may generate cold air by using latent heat of vaporization of the refrigerant through the cooling cycle. The cooling module 100 may be configured to generate cold air to be supplied to the first storage compartment 20*a*, the second storage compartment 20*ba*, and the third storage compartment 20*bb*. The cooling module 100 may be is attachable to or detachable from the cabinet 10 so that the cooling module is removably mounted to the outside of the cabinet 10.

Referring to FIG. 4, the cooling module 100 may include a module body 101, a base plate 103, a compressor 106, a condenser 107, an evaporator 111, and an expansion valve (not shown).

The module body 101 may form a part of the rear surface of the refrigerator 1. The module body 101 may include a module insulating material 101*a* provided to prevent loss of cold air generated from the evaporator 111.

The module body 101 may include receiving portions 101*b* and 101*c* in which the evaporator 111 is arranged. Particularly, the receiving portions 101*b* and 101*c* may include a first receiving portion 101*b* in which a first evaporator 111*a* is arranged and a second receiving portion 101*c* in which a second evaporator 111*b* is arranged.

The module body 101 may include a partition wall 101*d* arranged between the first receiving portion 101*b* and the second receiving portion 101*c*. The partition wall 101*d* may be arranged to correspond to a boundary between the second storage compartment 20*ba* and the third storage compartment 20*bb*. The module insulating material 101*a* may also be arranged in the partition wall 101*d*.

A connection duct 112 may be provided at the partition wall 101*d* to penetrate the module insulating material 101*a*. The connection duct 112 may be formed to allow cold air, which is to be supplied the third storage compartment 20*bb*, to move thereon. The connection duct 112 may be provided to allow the first receiving portion 101*b* to communicate with the second receiving portion 101*c*. One end of the connection duct 112 may be connected to a first fan connection port 121*d*, and the other end thereof may be connected to a second fan connection port 131*c*.

A third circulation duct 38 may be provided at the partition wall 101*d* to penetrate the module insulating material 101*a*. The third circulation duct 38 may be configured to allow air, which has cooled the third storage compartment 20*bb*, to flow to the second evaporator 111*b*. The third circulation duct 38 may allow the first receiving portion 101*b* to communicate with the second receiving portion 101*c*. The third circulation duct 38 may be configured to allow a part of a space, which is between a separation cover 125 and a first fan cover 123, to communicate with a space in which the second evaporator 111*b* is arranged.

A guide duct 113 may be provided in the module body 101. The guide duct 113 may be arranged to penetrate the module insulating material 101*a* of the module body 101. The guide duct 113 may be connected to the first circulation duct 36. The guide duct 113 may allow the first circulation duct 36 to communicate with the first receiving portion 101*b* in which the first evaporator 111*a* is arranged.

The base plate 103 may be arranged below the module body 101. The base plate 103 may cover the lower portion of the module body 101. The compressor 106 may be fixed to the base plate 103. The condenser 107 may be fixed to the base plate 103. A cooling fan 108 may be fixed to the base plate 103.

A water collection pan 103*a* may be arranged on the base plate 103. The water collection pan 103*a* may collect condensed water generated by the condenser 107 and/or the evaporator 111. The condenser 107 may be arranged above the water collection pan 103*a*.

The module body 101 may include a drain pan 104 and a drain pipe 104*a* for guiding condensed water generated in the evaporator 111 to the water collection pan 103*a*. The drain pan 104 may be arranged below the evaporator 111. The drain pan 104 may be arranged below the first evaporator 111*a* and the second evaporator 111*b*, respectively. The drain pan 104 may be arranged in the first receiving portion 101*b* and the second receiving portion 101*c*, respectively.

The drain pipe 104*a* may be configured to guide the condensed water collected in the drain pan 104 to the water collection pan 103*a*. At least a portion of the drain pipe 104*a* may be arranged to penetrate the module insulating material 101*a*.

An electrical box 140 may be arranged on the base plate 103. The electrical box 140 may be arranged at one side where the second receiving portion 101*c* is arranged. The electrical box 140 may control the cooling module 100 to change the temperatures of the storage compartments 20*a* and 20*b*. The electrical box 140 may be configured to receive power for driving the refrigerator 1. The electrical box 140 may be electrically connected to an electronic device 40 arranged in the cabinet 10, and the compressor 106, the condenser 107, the evaporator 111, the expansion valve 116, the cooling fan 108, the first duct module 120 and the second duct module 130 arranged in the cooling module 100.

A module cover 105 may cover the rear lower side of the module body 101. Together with the base plate 103, the module cover 105 may cover a machine room S, which is provided in the lower part of the module body 101 and receives the compressor 106, the condenser 107, and the cooling fan 108. The module cover 105 may include a cover inlet 105*a* through which the outside air is introduced by the cooling fan 108, and a cover outlet 105*b* through which the introduced air is discharged to the outside.

The compressor 106 may compress the refrigerant and move the compressed refrigerant to the condenser 107. The condenser 107 may condense the refrigerant and move the condensed refrigerant to the expansion valve. The cooling fan 108 may cool the compressor 106 and the condenser 107. As the cooling fan 108 is driven, air may flow into the machine room S through the cover inlet 105*a* and heat of the air may be exchanged with the condenser 107 and the compressor 106, and then the air may be discharged to the outside of the machine room S through the cover outlet 105*b*.

The above mentioned module body 101, base plate 103 and module cover 105 may be collectively referred as "module housing"

The evaporator 111 may be configured to generate cold air. The evaporator 111 may be arranged in the receiving portions 101*b* and 101*c*. The evaporator 111 may include the first evaporator 111*a* and the second evaporator 111*b*. The first evaporator 111*a* may be arranged in the first receiving portion 101*b*. The second evaporator 111*b* may be arranged in the second receiving portion 101*c*.

The cooling module 100 may include a cap 109 covering the open upper portions of the receiving portions 101*b* and 101*c*. The cap 109 may include a first cap 109*a* covering an upper portion of the first receiving portion 101*b* and a second cap 109*b* covering an upper portion of the second receiving portion 101*c*.

The first cap 109*a* may be arranged above the first duct module 120. The first cap 109*a* may include a first cap hole 109*aa* provided to correspond to a first fan outlet 121*b* formed in a first fan case 121, and a first cap hole 109*ab* provided to correspond to a first fan outlet 121*c* formed in the first fan case 121. The first cap hole 109*aa* may communicate with the first cold air duct 33. The first cap hole 109*ab* may communicate with the third cold air duct 35.

The second cap 109*b* may be arranged above the second duct module 130. The second cap 109*b* may include a second cap hole 109*ba* provided to correspond to a second fan outlet 131*b* formed in a second fan case 131. The second cap hole 109*ba* may communicate with the second cold air duct.

The duct modules 120 and 130 configured to move the cold air generated by the evaporator 111 to the storage compartments 20*a* and 20*b* may be arranged in the receiving portions 101*b* and 101*c*. The duct modules 120 and 130 may include the first duct module 120 arranged in the first receiving portion 101*b* and the second duct module 130 arranged in the second receiving portion 101*c*.

Particularly, referring to FIGS. 5 and 6, the first duct module 120 may include the first fan case 121, the first fan 122, the first fan cover 123, and a first duct cover 124, and the separation cover 125.

The first fan case 121 may be arranged to cover the first fan 122. The first fan case 121 may be removably coupled to the first receiving portion 101*b*. The first fan case 121 may be fixed to the module body 101.

The first fan case 121 may include a first fan inlet 121*a* through which air, which is heat-exchanged with the first evaporator 111*a*, is introduced. The first fan inlet 121*a* may be formed on the rear surface of the first fan case 121.

The first fan case 121 may include the first fan outlet 121*b* communicating with the first cold air duct 33. The first fan outlet 121*b* may discharge cold air to supplied to the first storage compartment 20*a*. The first fan outlet 121*b* may be formed on the upper surface of the first fan case 121.

The first fan case 121 may include the first fan outlet 121*c* communicating with the third cold air duct 35. The first fan outlet 121*c* may discharge cold air to be supplied to the third storage compartment 20*bb*. The first fan outlet 121*c* may be formed on the upper surface of the first fan case 121.

The first fan case 121 may include a first fan connection port 121*d* communicating with the connection duct 112. The first fan connection port 121*d* may be configured to allow air blown by a second fan 132 to be introduced. The first fan connection port 121*d* may be provided to allow cold air, which is to be supplied to the third storage compartment 20*bb*, to be introduced. The first fan connection port 121*d* may be formed on the side surface of the first fan case 121.

The first fan case 121 may include a first fan circulation port 121*e* communicating with the third circulation duct 38. The first fan circulation port 121*e* may be provided to guide the air, which has cooled the third storage compartment 20*bb*, to the second evaporator 111*b*. The first fan circulation port 121*e* may discharge air, which is introduced into the first duct module 120 through the first duct circulation port 127, to the second receiving portion 101*c* in which the second evaporator 111*b* is arranged. The first fan circulation port 121*e* may be formed at a side facing the partition wall 101*d* of the first fan case 121.

The first fan 122 may be driven to supply air, which is heat-exchanged with the first evaporator 111*a*, to the first storage compartment 20*a*. The first fan 122 may be arranged in the first receiving portion 101*b*. The first fan 122 may be fixed to the separation cover 125.

The first fan cover 123 may be coupled to the front of the first fan case 121. The separation cover 125 may be arranged between the first fan cover 123 and the first fan case 121. A separation rib 123*b* may be provided on the rear surface of the first fan cover 123 to divide a space between the separation cover 125 and the first fan cover 123. By the separation rib 123*b*, the space between the first fan cover 123 and the separation cover 125 may be divided into a space where air is supplied from the connection duct 112 and a space where air, which has cooled the third storage compartment 20*bb*, is collected.

The separation cover 125 may cover the front of the first fan case 121. The separation cover 125 may divide a space formed by the first fan case 121 and the first fan cover 123. Together with the first fan case 121, the separation cover 125 may form a space, in which cold air, which is to be supplied to the first storage case 20*a*, flows. Together with the first fan cover 123, the separation cover 125 may form a space, in which cold air, which is to be supplied to the third storage compartment 20*bb*, flows. At the rear of the separation cover 125, a flow path on which air, which is heat-exchanged with the first evaporator 111*a*, flows, is formed, and at the front of the separation cover 125, a flow path on which air, which is heat-exchanged with the second evaporator 111*b*, flows is formed. At the rear of the separation cover 125, a flow path on which air, which is moved by the first fan 122, flows, may be formed, and at the front of the separation cover 125, a flow path on which air, which is moved by the second fan 132, flows, may be formed.

The separation cover 125 may prevent the air, which is heat-exchanged with the first evaporator 111*a*, from mixing with the air, which is heat-exchanged with the second evaporator 111*b*. The separation cover 125 may prevent the air, which is moved by the first fan 122, from mixing with the air, which is moved by the second fan 132. The separation cover 125 may support the first fan 122.

The separation cover 125 may include a hole forming portion 125*a* configured to form a hole communicating with the third cold air duct 35 upon being coupled to the first fan cover 123. The hole forming portion 125*a* may be formed at an upper portion of the separation cover 125.

The separation cover 125 may include a connection duct damper 114 configured to regulate an amount of cold air passing through the connection duct 112. According to an opening degree of the connection duct damper 114, a temperature of the third storage compartment 20*bb* may be adjusted.

The first fan cover 123 may be arranged in front of the separation cover 125. Together with the separation cover 125, the first fan cover 123 may form a space in which cold air, which is to be supplied to the third storage compartment 20*bb*, flows. The first fan cover 123 may be fixed to the first fan case 121.

The first fan cover 123 may include a first cover hole 123*a* communicating with the third storage compartment 20*bb*. The first cover hole 123*a* may be configured to discharge a portion of the air, which is introduced through the connection duct 112, to the third storage compartment 20*bb*. A portion of the cold air introduced through the connection duct 112 may be moved to the third cold air duct 35 and then supplied to the third storage compartment 20*bb*, and the other portion thereof may be supplied to the third storage compartment 20*bb* through the first cover hole 123*a*.

The first duct cover 124 may be arranged in front of the first fan cover 123. The first duct cover 124 may cover the front of the first fan cover 123. The first duct cover 124 may include a first duct hole 124*a* communicating with the third storage compartment 20*bb*. The first duct hole 124*a* may be provided to correspond to the first cover hole 123*a*. A portion of the cold air blown by the second fan 132 may be supplied to the third storage compartment 20*bb* through the first cover hole 123*a* and the first duct hole 124*a*.

The first duct cover 124 may include a first duct entering portion 124*b*. The first duct entering portion 124*b* may be arranged to be spaced apart from the module body 101 by a predetermined distance. Together with the module body 101, the first duct entering portion 124*b* may form the first duct circulation port 127. Air, which has cooled the third storage compartment 20*bb*, may be collected to the first duct module 120 through the first duct circulation port 127. Air, which is collected through the first duct circulation port 127, may be guided to the second evaporator 111*b* through the third circulation duct 38.

The second duct module 130 may include the second fan case 131, the second fan 132, a second fan cover 133, and a second duct cover 134.

The second fan case 131 may be arranged in the second receiving portion 101*c*. The second fan case 131 may include a second fan inlet 131*a* through which air, which is heat-exchanged with the second evaporator 111*b*, is introduced. The second fan inlet 131*a* may be formed on the rear surface of the second fan case 131.

The second fan case 131 may include the second fan outlet 131*b* communicating with the second cold air duct. The second fan outlet 131*b* may discharge cold air to be supplied to the second storage compartment 20*ba*. The second fan outlet 131*b* may be formed on an upper surface of the second fan case 131.

The second fan case 131 may include the second fan connection port 131*c* communicating with the connection duct 112. The second fan connection port 131*c* may be configured to discharge air blown by the second fan 132 to the connection duct 112. The second fan connection port 131*c* may be provided to discharge cold air to be supplied to the third storage compartment 20*bb*. The second fan connection port 131*c* may be formed on the side surface of the second fan case 131.

The second fan 132 may be driven to supply air, which is heat-exchanged with the second evaporator 111*b*, to the second storage compartment 20*ba* and the third storage compartment 20*bb*. The second fan 132 may be arranged in the second receiving portion 101*c*. The second fan 132 may be fixed to the second fan cover 133.

The second fan cover 133 may be coupled to the front of the second fan case 131. The second fan cover 133 may cover the front of the second fan case 131. Together with the second fan case 131, the second fan cover 133 may form a space in which cold air, which is to be supplied to the second storage compartment 20*ba* and the third storage compartment 20*bb*, flows. The second fan cover 133 may be fixed to the second fan case 131.

The second fan cover 133 may include a second cover hole 133*a* communicating with the second storage compartment 20*ba*. The second cover hole 133*a* may be formed to discharge a portion of the air, which is blown by the second fan 132, to the second storage compartment 20*ba*. A portion of the air blown by the second fan 132 may be moved to the second cold air duct and then supplied to the second storage compartment 20*ba*, and the other portion thereof may be supplied to the second storage compartment 20*bb* through the second cover hole 133*a*. The second fan cover 133 may support the second fan 132.

The second duct cover 134 may be arranged in front of the second fan cover 133. The second duct cover 134 may cover the front of the second fan cover 133.

The second duct cover 134 may include a second duct hole 134*a* communicating with the second storage compartment 20*ba*. The second duct hole 134*a* may be provided to correspond to the second cover hole 133*a*. A portion of the cold air blown by the second fan 132 may be supplied to the second storage compartment 20*ba* through the second cover hole 133*a* and the second duct hole 134*a*.

The second duct cover 134 may include a second duct entering portion 134*b*. The second duct entering portion 134*b* may be arranged to be spaced apart from the module body 101 by a predetermined distance. Together with the module body 101, the second duct entering portion 134*b* may form a second duct circulation port 137. Through the second duct circulation port 137, air, which has cooled the second storage compartment 20*ba*, may be collected to the second duct module 130. The air collected through the second duct circulation port 137 may be guided to the second evaporator 111*b*.

A portion of air, which has cooled the third storage compartment 20*bb*, may be moved to the second storage compartment 20*ba* through the second circulation duct 37. The second circulation duct 37 may be arranged to penetrate the separation plate 18. The air, which is moved to the second storage compartment 20*ba* through the second circulation duct 37, may be collected to the second receiving portion 101*c* together with the air, which has cooled the second storage compartment 20*ba*.

With this configuration, as for the refrigerator 1 according to an embodiment of the disclosure, it is possible to arrange all components of the cold air supply system of the refrigerator 1 in the cooling module 100, and it is possible to removably mount the cooling module 100 to the cabinet 10. Therefore, it is possible to test the cooling performance of the cold air supply system prior to mounting the cooling module 100 to the cabinet 10. Further, it is possible to separate only the cooling module 100 from the cabinet when maintaining or repairing the cold air supply system, and thus it is possible to easily maintain and repair the refrigerator 1.

Figure 7:
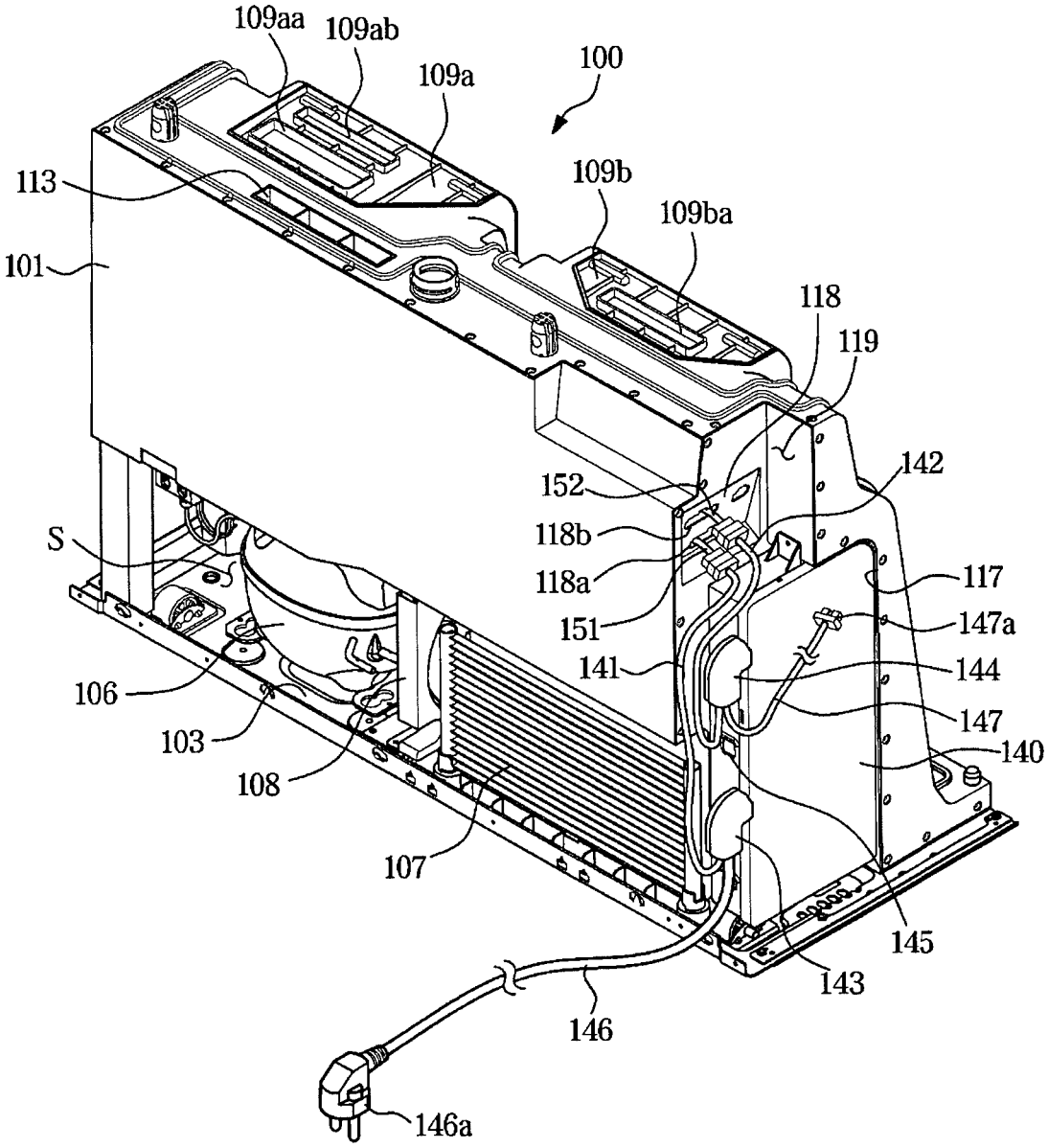
FIG. 7 is a view illustrating a rear of the cooling module shown in FIG. 2.
Figure 8:
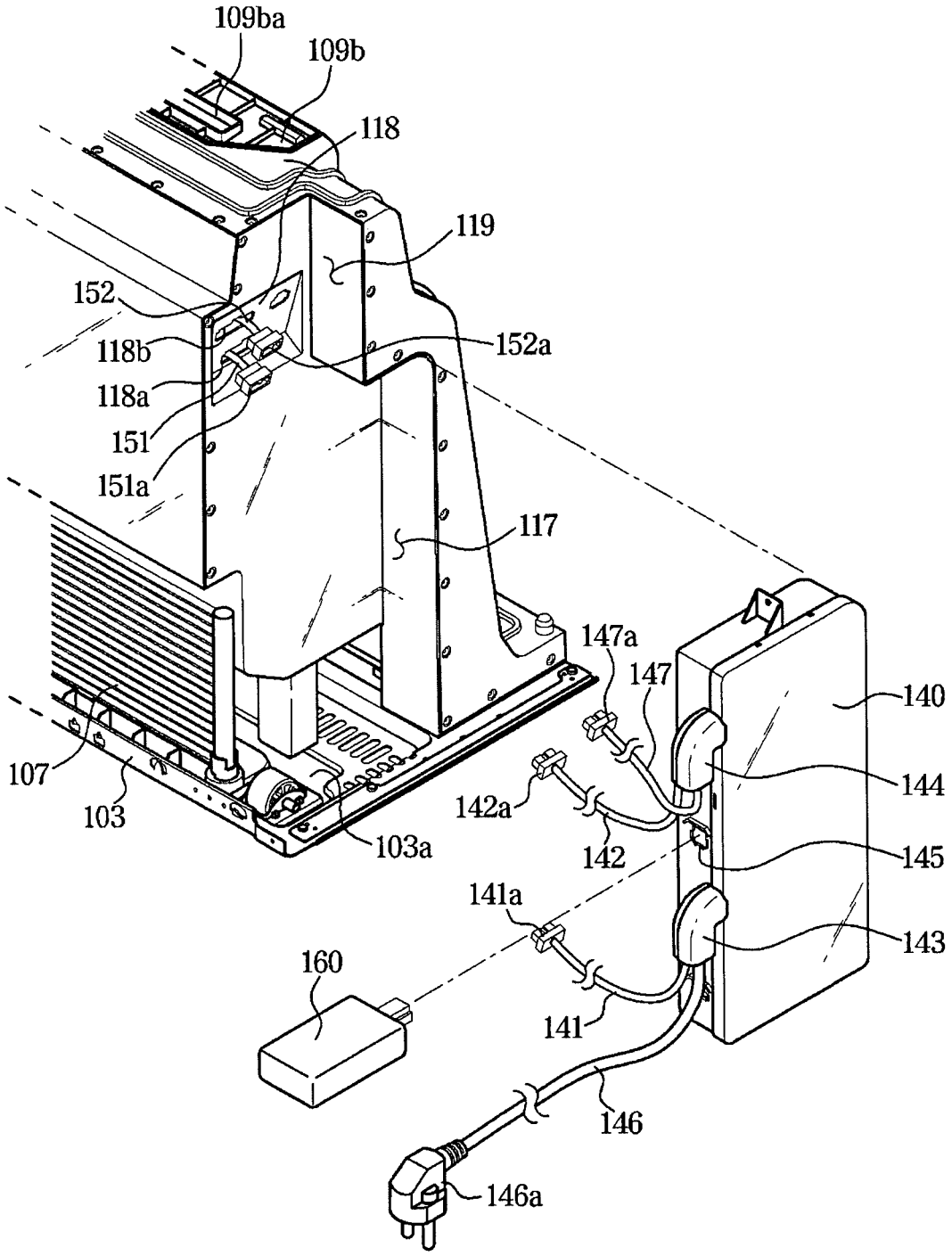
FIG. 8 is a view illustrating a state in which an electrical box is separated from a module body of the cooling module shown in FIG. 7.
Figure 9:
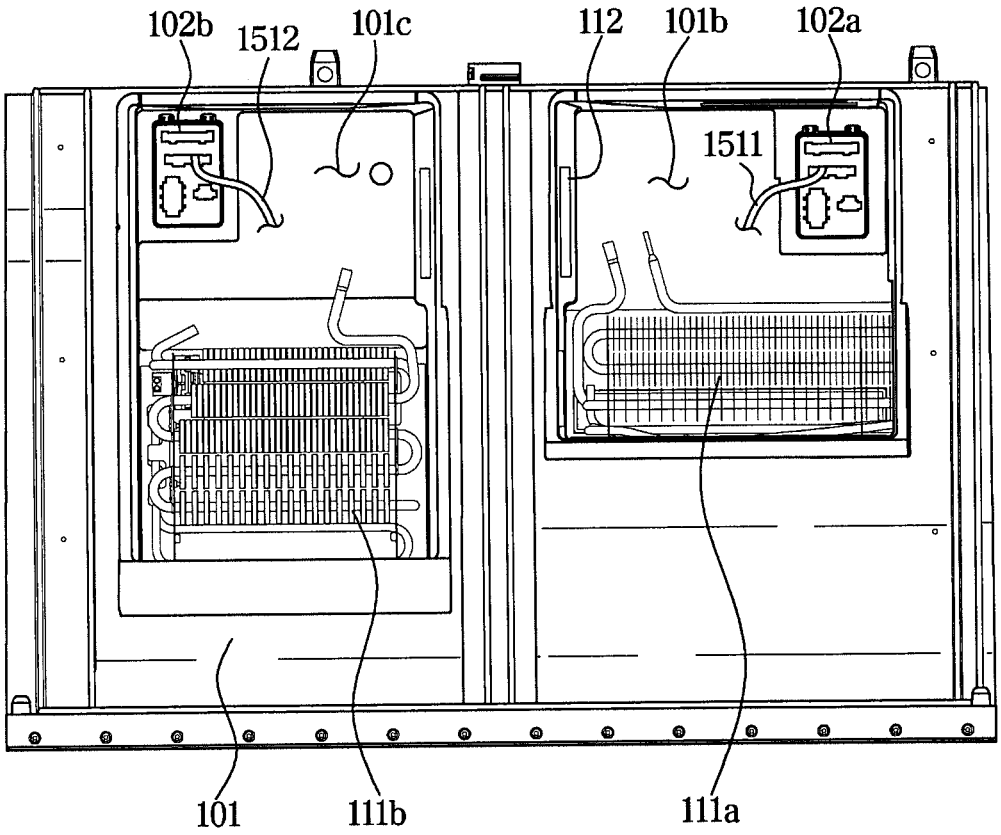
FIG. 9 is a front view of the cooling module shown in FIG. 4.
Figure 10:
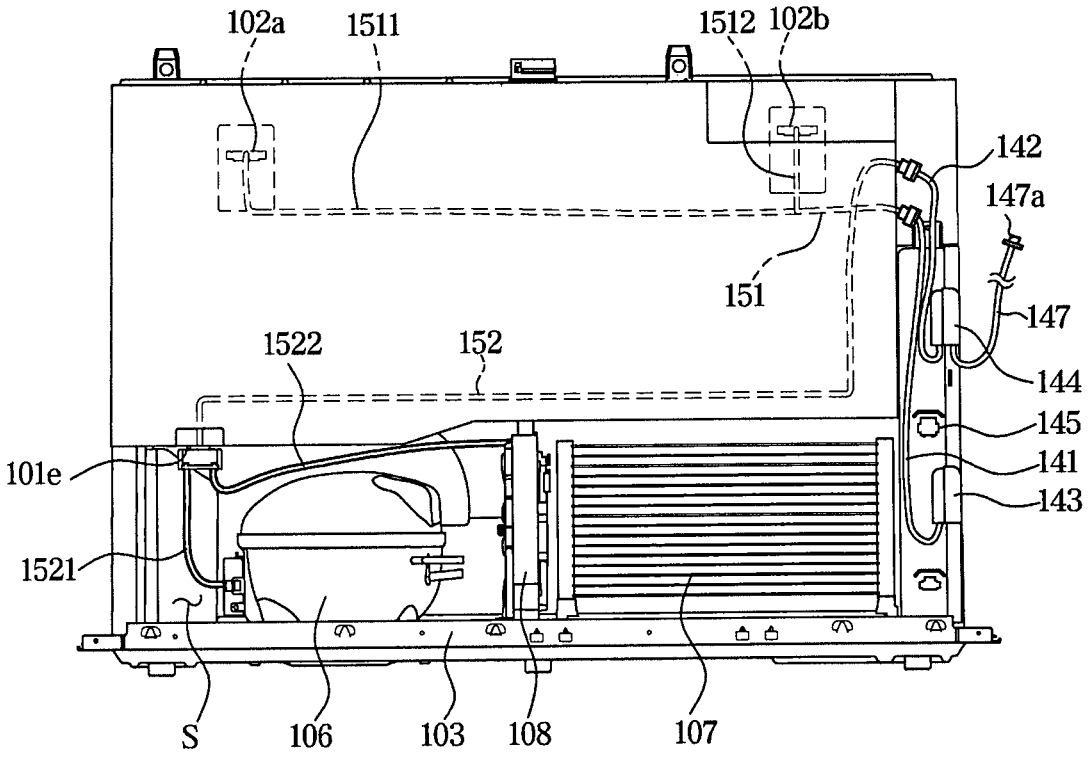
FIG. 10 is a view illustrating a state in which a second wire shown in FIG. 7 extends from the electrical box to a machine room.

FIG. 7 is a view illustrating a rear of the cooling module shown in FIG. 2. FIG. 8 is a view illustrating a state in which an electrical box is separated from a module body of the cooling module shown in FIG. 7. FIG. 9 is a front view of the cooling module shown in FIG. 4. FIG. 10 is a view illustrating a state in which a second wire shown in FIG. 7 extends from the electrical box to a machine room.

Referring to FIGS. 7 to 9, the module body 101 may include a receiving portion opening 102 configured to guide first wires 141 and 151, which extends from the electrical box 140, to the receiving portions 101*b* and 101*c*. The receiving portion opening 102 may include a first receiving portion opening 102*a* configured to guide the first wires 141 and 151, which extends from the electrical box 140, to the first receiving portions 101*b*, and a second receiving portion opening 102*b* configured to guide the first wires 141 and 151, which extends from the electrical box 140, to the second receiving portions 101*c*. The first receiving portion opening 102*a* may be formed in the first receiving portion 101*b*, and the second receiving portion opening 102*b* may be formed in the second receiving portion 101*c*. The first receiving portion opening 102*a* may be formed to penetrate the first receiving portion 101*b* and the inside of the module body 101, and the second receiving portion opening 102*b* may be formed to penetrate the second receiving portion 101*c* and the inside of the module body 101.

The module body 101 may include an electrical box mounting portion 117 on which the electrical box 140 is mounted. The electrical box mounting portion 117 may be provided in the size and shape corresponding to the electrical box 140. The electrical box mounting portion 117 may be arranged on one side where the second receiving portion 101*c* of the module body 101 is formed. The electrical box mounting portion 117 may be arranged at the rear of one side of the module body 101. The electrical box mounting portion 117 may be arranged adjacent to the condenser 107. The electrical box 140 may be removably mounted to the electrical box mounting portion 117.

The electrical box 140 may be electrically connected to electronic components arranged in the cooling module 100 through the first wires 141 and 151 and second wires 142 and 152. The electronic component arranged in the cooling module 100 may include the compressor 106, the condenser 107, the evaporator 111, the expansion valve 116, the cooling fan 108, the first duct module 120 and the second duct module 130. The electrical box 140 may be electrically connected to the electronic device 40 arranged in the cabinet 40 through a cabinet wire 147.

The first wires 141 and 151 may electrically connect the electrical box 140 to the evaporator 111 and/or the duct modules 120 and 130 arranged in the receiving portions 101*b* and 101*c*. The first wires 141 and 151 may transmit power and/or control signals from the electrical box 140 to the evaporator 111 and/or the duct modules 120 and 130. The first wires 141 and 151 may include a first electrical box wire 141 and a first module wire 151.

The first electrical box wire 141 may extend from the electrical box 140. The first electrical box wire 141 may extend to the outside of the electrical box 140 through a first wire guide 143. The first wire guide 143 may protrude from one surface of the electrical box 140 to guide the first electrical box wire 141 to the outside of the electrical box 140.

The first electrical box wire 141 may include a first electrical box connector 141*a* provided at an end portion far from the electrical box 140. The first electrical box connector 141*a* may be coupled to a first module connector 151*a* provided at an end portion of the first module wire 151. Accordingly, the first electrical box wire 141 may be electrically connected to the first module wire 151.

The first module wire 151 may be guided into the module body 101 through a first wire opening 118*a* of a wire opening 118. At least one portion of the first module wire 151 may be arranged to penetrate the module insulating material 101*a*.

Referring to FIGS. 9 and 10, the first module wire 151 may include a first module connector 151*a* electrically connected to the first electrical box connector 141*a*. In the module body 101, the first module wire 151 may be divided into a first a (1*a*) module wire 1511 extending to the first receiving portion 101*b*, and a first b (1*b*) module wire 1512 extending to the second receiving portion 101*c*.

The first a module wire 1511 may extend to the first receiving portion 101*b* through the first receiving portion opening 102*a*. The first a module wire 1511 may be electrically connected to the first evaporator 111*a* and/or the first duct module 120 in the first receiving portion 101*b*.

The first b module wire 1512 may extend to the second receiving portion 101*c* through the second receiving portion opening 102*b*. The first b module wire 1512 may be electrically connected to the second evaporator 111*b* and/or the second duct module 130 in the second receiving portion 101*c*.

The second wires 142 and 152 may electrically connect the electrical box 140 to the compressor 106, the condenser 107, and/or the cooling fan 108 arranged in the machine room S. Particularly, referring to FIG. 10, the module body 101 may include a machine room opening 101*e* formed to guide the second wires 142 and 152 extending toward the machine room S. The machine room opening 101*e* may be formed on one surface of the module body 101 facing the machine room S. The machine room opening 101*e* may be formed to penetrate the inside of the machine room S and the module body 101.

The second wires 142, and 152 may transmit power and/or control signals from the electrical box 140 to the compressor 106, the condenser 107, and/or the cooling fan 108. The second wires 142 and 152 may include a second electrical box wire 142 and a second module wire 152.

The second electrical box wire 142 may extend from the electrical box 140. The second electrical box wire 142 may extend to the outside of the electrical box 140 through a second wire guide 144. The second wire guide 144 may protrude from one surface of the electrical box 140 to guide the second electrical box wire 142 to the outside of the electrical box 140.

The second electrical box wire 142 may include a second electrical box connector 142*a* provided at an end portion far from the electrical box 140. The second electrical box connector 142*a* may be coupled to a second module connector 152*a* provided at an end portion of the second module wire 152. Accordingly, the second electrical box wire 142 may be electrically connected to the second module wire 152.

The second module wire 152 may be guided into the module body 101 through a second wire opening 118*b* of the wire opening 118. The second module wire 152 may be arranged such that at least one portion thereof penetrates the module insulating material 101*a*.

The second module wire 152 may include the second module connector 152*a* electrically connected to the second electrical box connector 142*a*. The second module wire 152 may extend to the machine room and then be divided into a compressor wire 1521 extending to the compressor 106 and a cooling fan wire 1522 extending to the cooling fan 108. Although not shown, the second module wire 152 may also include a condenser wire (not shown) connected to the condenser 107.

The compressor wire 1521 may be electrically connected to the compressor 106, and the cooling fan wire 1522 may be electrically connected to the cooling fan 108.

The electrical box 140 may receive power from the outside through a power wire 146. A power plug 146*a* may be provided at an end of the power wire 146. The electrical box 140 supplies power, which is received through the power wire 146, to components needed for driving the refrigerator 1, through the first wires 141 and 151, the second wires 142 and 152, and the cabinet wire 147.

The electrical box 140 may transmit power and/or control signals from the electrical box 140 to the electronic device 40 arranged in the cabinet 10 through the cabinet wire 147. The cabinet wire 147 may be electrically connected to an electronic device wire (not shown) electrically connected to the electronic device 40 arranged in the cabinet 10. The cabinet wire 147 may extend to the outside of the electrical box 140 through the second wire guide 144. Alternatively, the cabinet wire 147 may extend to the outside of the electrical box 140 through the first wire guide 143, or may extend to the outside of the electrical box 140 through a separate guide (not shown).

The module body 101 may include the wire opening 118 configured to guide the first module wire 151 and the second module wire 152 into the module body 101. The wire opening 118 may include the first wire opening 118*a* and the second wire opening 118*b*.

The first wire opening 118*a* may be formed to pass through the module body 101 to allow the first module wire 151 to extend into the module body 101. The second wire opening 118*b* may be formed to pass through the module body 101 to allow the second module wire 152 to extend into the module body 101.

The module body 101 may include a connector receiving space 119 in which connectors 141*a*, 142*a*, 151*a*, 152*a*, and 147*a*, which are provided in the first wires 141 and 151, the second wires 142 and 152, and the cabinet wires 147, are placed. The connector receiving space 119 may be formed adjacent to the electrical box mounting portion 117. The wire opening 118 may be arranged in the connector receiving space 119.

The cooling module 100 may be formed in the following manner. The compressor 106, the condenser 107, the cooling fan 108, the evaporator 111, and/or the duct modules 120 and 130 may be installed in the module body 101. The first module wire 151 and the second module wire 152 may be connected to the compressor 106, the condenser 107, the cooling fan 108, the evaporator 111, and/or the duct modules 120 and 130. The first module connector 151*a* of the module wire 151 and the second module connector 152*a* of the second module wire 152 may be arranged in the connector receiving space 119. The inside of the module body 101 may be filled with the module insulating material 101*a*.

After installing the compressor 106, the condenser 107, the cooling fan 108, the evaporator 111, the duct modules 120 and 130, the first module wire 151 and the second module wire 152 to the module body 101, the electrical box 140 may be installed in the module body 101. Particularly, the electrical box 140 may be installed in the electrical box mounting portion 117, the first electrical box wire 141 may be connected to the first module wire 151, and the second electrical box wire 142 may be connected to the second module wire 152.

In addition, when the cooling module 100 is coupled to the cabinet 10, the cabinet wire 147 may be connected to an electronic device wire (not shown) extending from the electronic devices 40 arranged in the cabinet 10.

With this configuration, the refrigerator 1 according to an embodiment of the disclosure may be easily assembled, and thus productivity may be increased.

The electrical box 140 may include a test connector 145 arranged to be exposed to the outside of the electrical box 140. The test connector 145 may be electrically connected to a test device 160. The test device 160 may be configured to include software configured to test the performance of the cold air supply system of the cooling module 100.

With this configuration, as for the refrigerator 1, because the test connector 145 of the cooling module 100 is connected to the test device 160, it is possible to perform the performance test of the cooling module 100 before the cooling module 100 is mounted to the cabinet 10. That is, before the manufacturing process of the refrigerator 1 is completed, it is possible to test the performance of the cold air supply system and to test whether the cold air supply system is operated, and thus it is possible to reduce the loss occurring in the manufacturing process and to increase the productivity.

Further, referring to FIG. 2, the cabinet 10 may include an electrical box heat dissipation opening 19 configured to allow the electrical box 140 to be exposed to the outside to dissipate the heat of the electrical box 140 arranged in the cooling module 100. The electrical box heat dissipation opening 19 may be arranged in the cooling module mounting portion 15. The electrical box heat dissipation opening 19 may be formed to penetrate the cabinet 10. By the electrical box heat dissipation opening 19, the heat of the electrical box 140 may be effectively dissipated, thereby preventing the degradation of the electrical box 140.

Figure 11:
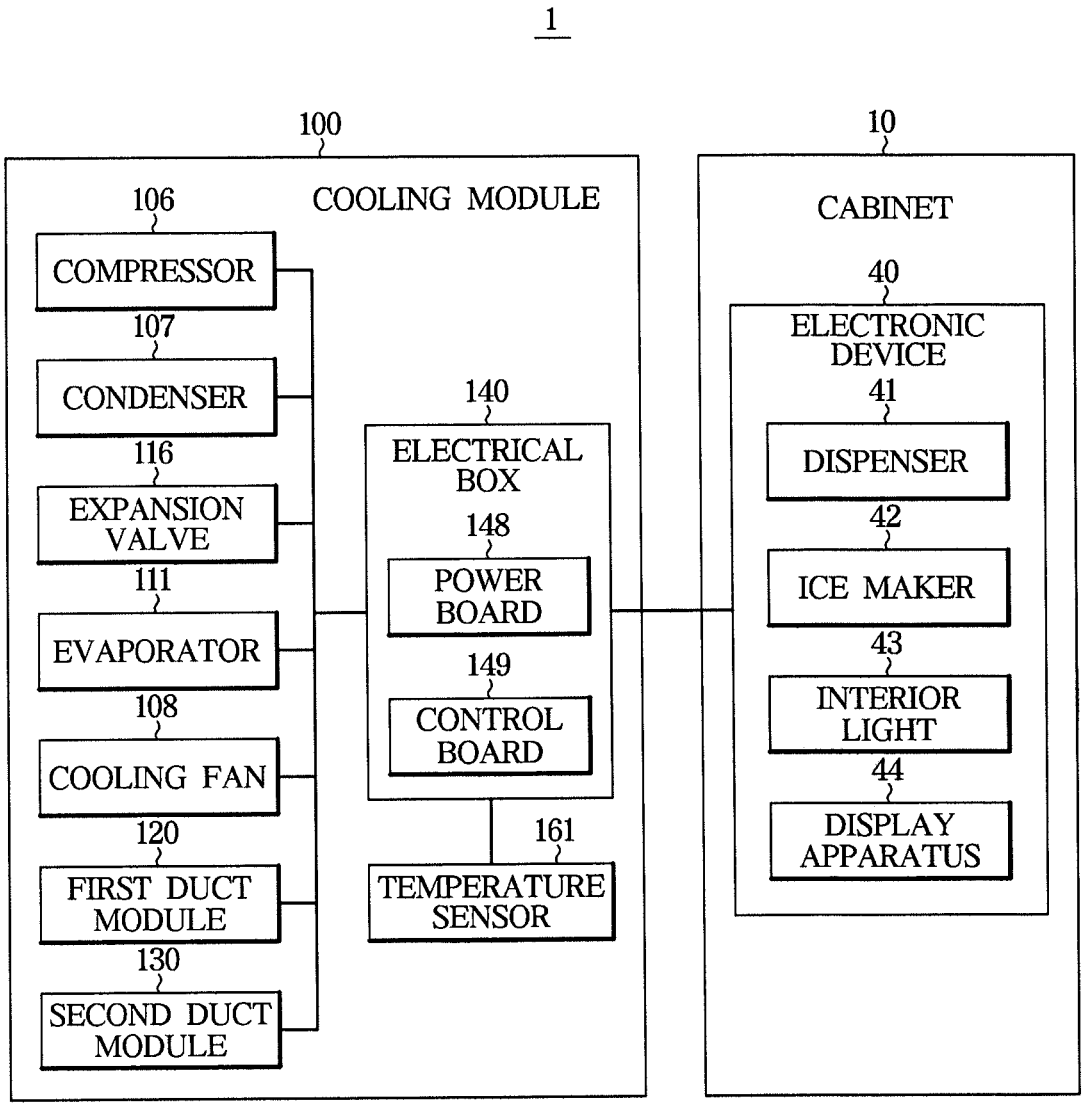
FIG. 11 is a diagram schematically illustrating components of the refrigerator electrically connected to the electrical box shown in FIG. 4.

FIG. 11 is a diagram schematically illustrating components of the refrigerator electrically connected to the electrical box shown in FIG. 4.

An electrical connection between the electrical box 140 of the refrigerator 1 according to an embodiment of the disclosure, and the electronic device 40 arranged in the cabinet 10 and electronic components arranged in the cooling module 100 will be described with reference to FIG. 11.

Referring to FIG. 11, the electrical box 140 may be arranged in the cooling module 100. In the cooling module 100, the compressor 106, the condenser 107, the expansion valve 116, the evaporator 111, the cooling fan 108, the first duct module 120, and the second duct module 130 may be arranged. Further, a temperature sensor 161 may be arranged in the cooling module 100.

In the cabinet 10, the electronic device 40 configured to operate by receiving power may be arranged. The electronic device 40 may include at least one of a dispenser 41, an ice maker 42, an interior light 43, and a display apparatus 44.

The electrical box 140 may include a power board 148 configured to receive power from the outside and transmit the power to the electronic component arranged in the cooling module 100 and/or the electronic device 40 arranged in the cabinet 10, and a control board 149 configured control the electronic component arranged in the cooling module 100 and/or the electronic device 40 arranged in the cabinet 10 by receiving the power from the power board 148. The power board 148 may be electrically connected to the power wire 146, the first electrical box wire 141, the second electrical box wire 142, and the cabinet wire 147. The control board 149 may be electrically connected to the first electrical box wire 141, the second electrical box wire 142, and the cabinet wire 147.

By being electrically connected to the compressor 106, the condenser 107, the expansion valve 116, and the evaporator 111, the electrical box 140 may supply the power to the cold air supply system, or regulate a flow rate of the refrigerant by controlling the cold air supply system.

The electrical box 140 may be electrically connected to the cooling fan 108 to supply power to the cooling fan 108 or adjust the rotational speed of the cooling fan 108 so as to effectively dissipate the heat of the machine room S.

By being electrically connected to the first duct module 120 and/or the second duct module 130, the electrical box 140 may supply power to the first duct module 120 and/or the second duct module 130. Alternatively, the electrical box 140 may regulate the amount of refrigerant supplied to the storage compartments 20*a* and 20*b* by adjusting the rotational speed of the first fan 122 of the first duct module 120 and/or the rotational speed of the second fan 132 of the second duct module 130. Accordingly, the electrical box 140 may adjust the temperature of the storage compartments 20*a* and 20*b*.

The electrical box 140 may be electrically connected to the temperature sensor 161 to receive information on a temperature of the cold air generated from the evaporator 111 from the temperature sensor 161, and control the cold air supply system based on the temperature information. The temperature sensor 161 may be arranged adjacent to the evaporator 111 of the cooling module 100. The temperature sensor 161 may be arranged in the receiving portions 101*b* and 101*c*. The temperature sensor 161 may be provided in plurality to be respectively arranged in the first receiving portion 101*b* and the second receiving portion 101*c*. The temperature sensor 161 may measure the temperature of the cold air generated by the evaporator 111 and transmit the temperature of the cold air to the electrical box 140. The temperature sensor 161 may be driven by receiving power from the electrical box 140.

The electrical box 140 may be electrically connected to the cabinet electronic device 40 through the cabinet wire 147.

The dispenser 41 may be arranged in the upper door 21*a* of the refrigerator 1. The electrical box 140 may be electrically connected to the dispenser 41 to supply power to the dispenser 41 or to control the dispenser 41.

The ice maker 42 may be arranged in the upper storage compartment 20*a*. The electrical box 140 may be electrically connected to the ice maker 42 to supply power to the ice maker 42 or to control the ice maker 42.

The interior light 43 may be arranged in the storage compartments 20*a* and 20*b*. The electrical box 140 may be electrically connected to the interior light 43 to supply power to the interior light 43 or to flash the interior light 43.

The display apparatus 44 may be arranged on the upper door 21*a*. The electrical box 140 may be electrically connected to the display apparatus 44 to supply power to the display apparatus 44 or to control the display apparatus 44.

With this configuration, the refrigerator 1 according to an embodiment of the disclosure may supply power or control the electronic device 40 arranged in the cabinet 10 and electronic components arranged in the cooling module 100, by using a single electrical box 140.

Figure 12:
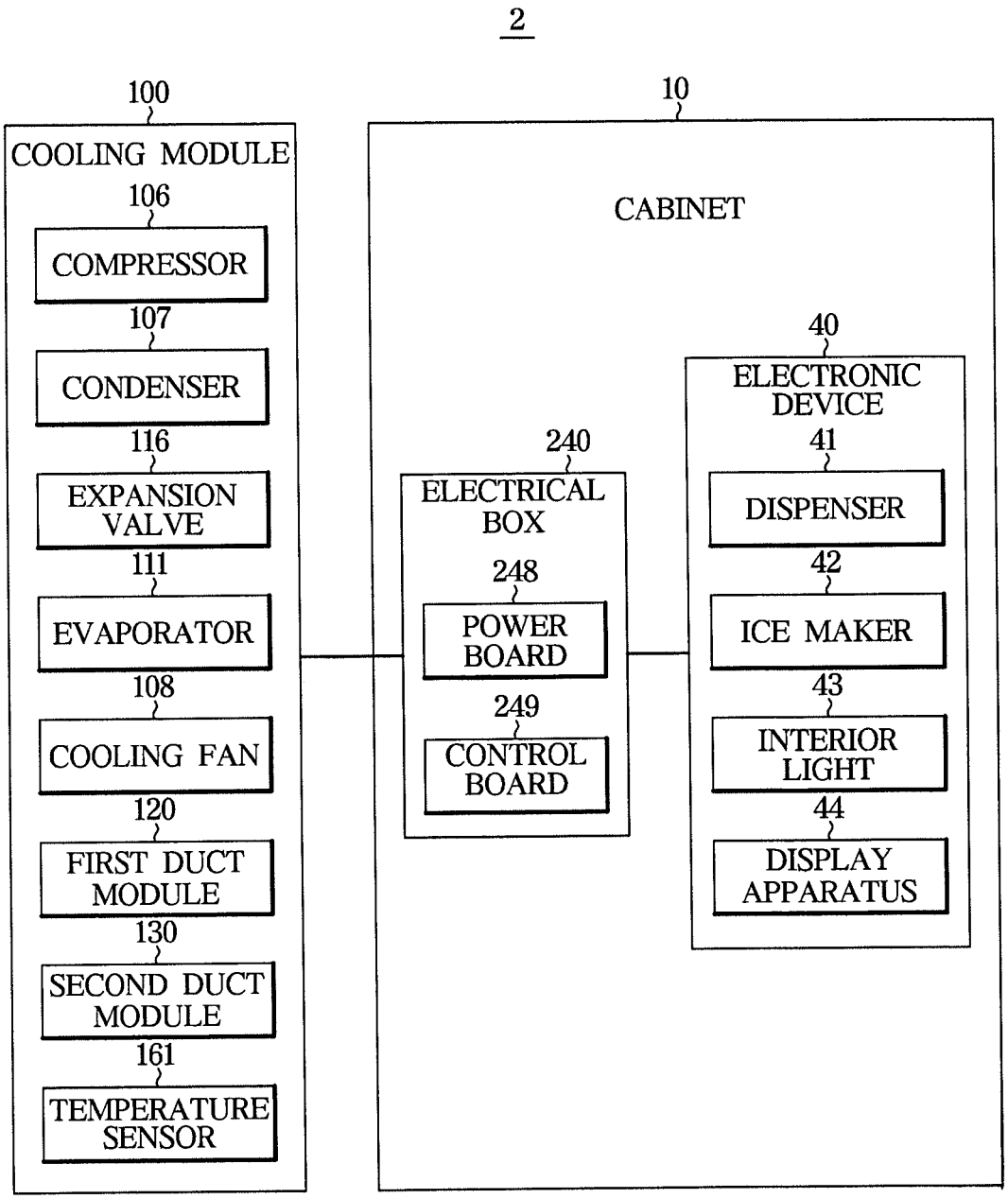
FIG. 12 is a diagram schematically illustrating components of a refrigerator according to another embodiment of the disclosure electrically connected to an electrical box

FIG. 12 is a diagram schematically illustrating components of a refrigerator according to another embodiment of the disclosure electrically connected to an electrical box.

An electrical connection between an electrical box 240 of a refrigerator 2 according to another embodiment of the disclosure, and an electronic device 40 arranged in a cabinet 10 and electronic components arranged in a cooling module 100 will be described with reference to FIG. 12.

Referring to FIG. 12, the electrical box 240 may be arranged in the cabinet 10. In the electrical box 240 arranged in the cabinet 10, a first electrical box wire 141 and a second electrical box wire 142 may extend to the cooling module 100. The first electrical box wire 141 extending to the cooling module 100 may be electrically connected to a first module wire 151, and the second electrical box wire 142 may be electrically connected to a second module wire 152. Accordingly, the electrical box 240 arranged in the cabinet 10 may supply power to or control the electronic components arranged in the cooling module 100.

Particularly, a compressor 106, a condenser 107, an expansion valve 116, an evaporator 111, a cooling fan 108, a first duct module 120, a second duct module 130, and a temperature sensor 161 may be arranged in the cooling module 100.

In the cabinet 10, the electronic device 40 configured to operate by receiving power and the electrical box 240 may be arranged. The electronic device 40 may include at least one of a dispenser 41, an ice maker 42, an interior light 43, and a display apparatus 44.

The electrical box 240 may include a power board 248 configured to receive power from the outside and transmit the power to the electronic component arranged in the cooling module 100 and/or the electronic device 40 arranged in the cabinet 10, and a control board 249 configured control the electronic component arranged in the cooling module 100 and/or the electronic device 40 arranged in the cabinet 10 by receiving the power from the power board 248.

By being electrically connected to the compressor 106, the condenser 107, the expansion valve 116, and the evaporator 111, the electrical box 240 may supply the power to the cold air supply system, or regulate a flow rate of the refrigerant by controlling the cold air supply system.

The electrical box 240 may be electrically connected to the cooling fan 108 to supply power to the cooling fan 108 or adjust the rotational speed of the cooling fan 108 so as to effectively dissipate the heat of the machine room S.

By being electrically connected to the first duct module 120 and/or the second duct module 130, the electrical box 240 may supply power to the first duct module 120 and/or the second duct module 130. Alternatively, the electrical box 240 may regulate the amount of refrigerant supplied to the storage compartments 20*a* and 20*b* by adjusting the rotational speed of the first fan 122 of the first duct module 120 and/or the rotational speed of the second fan 132 of the second duct module 130. Accordingly, the electrical box 240 may adjust the temperature of the storage compartments 20*a* and 20*b*.

The electrical box 240 may be electrically connected to the temperature sensor 161 to receive information on a temperature of the cold air generated from the evaporator 111 from the temperature sensor 161, and control the cold air supply system based on the temperature information.

The electrical box 240 may be electrically connected to the dispenser 41 to supply power to the dispenser 41 or to control the dispenser 41. The electrical box 240 may be electrically connected to the ice maker 42 to supply power to the ice maker 42 or to control the ice maker 42. The electrical box 240 may be electrically connected to the interior light 43 to supply power to the interior light 43 or to flash the interior light 43. The electrical box 240 may be electrically connected to the display apparatus 44 to supply power to the display apparatus 44 or to control the display apparatus 44.

With this configuration, the refrigerator 2 according to another embodiment of the disclosure may supply power or control the electronic device 40 arranged in the cabinet 10 and electronic components arranged in the cooling module 100, by using a single electrical box 240.

As is apparent from the above description, because the compressor, the condenser, the expansion valve and the evaporator are mounted to the cooling module is attachable to or detachable from the cabinet so that the cooling module is removably coupled to the cabinet and the electrical box configured to control the configuration of the cold air supply system is integrally arranged in the cooling module, it is possible to perform the performance test of the cold air supply system before the manufacturing process of the refrigerator is completed.

Because it is possible to perform the performance test of the cold air supply system before the manufacturing process of the refrigerator is completed, it is possible to reduce the loss in the manufacturing process, thereby improving the productivity.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a cabinet including:

a first compartment;

a second compartment disposed below the first compartment; and a third compartment disposed below the first compartment and disposed next to the second compartment;

a cooling module attachable to or detachable from a rear side of the cabinet so that the cooling module is removably mountable to the cabinet, the cooling module comprising:

a module body comprising:

a first receiving portion; and a second receiving portion;

a partition wall between the first receiving portion and the second receiving portion to separate the first receiving portion and the second receiving portion, the partition wall comprising a connection duct formed by penetrating the partition wall to communicate the first receiving portion and the second receiving portion;

a first duct module to be accommodated in the first receiving portion, the first duct module comprising:

a first fan; and a first fan connection port formed therein;

a second duct module to be accommodated in the second receiving portion, the second duct module comprising:

a second fan; and a second fan connection port formed therein, to be connected to the first fan connection port;

a compressor;

a condenser;

an expansion valve; and an evaporator comprising:

a first evaporator to be connected to the first duct module; and a second evaporator to be connected to the second duct module, an electronic device arranged in the cabinet; and an electrical box configured to be electrically connected to the electronic device and the compressor, receive power from an external power source, and supply the received power to the electronic device and the compressor, wherein the first duct module is configured to move cold air generated by the first evaporator to the first compartment and the third compartment, and the second duct module is configured to move the cold air generated by the second evaporator to the second compartment and the first duct module through the connection duct, and wherein the first fan connection port and the second fan connection port are communicated through the connection duct so that the cold air discharged from the first duct module is introduced into the second duct module through the connection duct.

2. The refrigerator of claim 1, wherein the electrical box is arranged in the cooling module, and the cooling module comprises a module body comprising an electrical box mounting portion to which the electrical box is mounted.

3. The refrigerator of claim 2, wherein the module body comprises a receiving portion in which the evaporator is arranged and a receiving portion opening formed therein and configured to guide a first wire extending to the receiving portion.

4. The refrigerator of claim 3, wherein a module insulating material is provided inside the module body, and the first wire is arranged so that a portion of the first wire passes through the module insulating material.

5. The refrigerator of claim 3, wherein the cooling module comprises a duct module arranged in the receiving portion, and the first wire electrically connects the duct module to the electrical box.

6. The refrigerator of claim 2, wherein the module body comprises a machine room in which the compressor and the condenser are arranged and a machine room opening formed therein and configured to guide a second wire extending to the machine room.

7. The refrigerator of claim 6, wherein a module insulating material is provided inside the module body, and the second wire is arranged so that a portion of the second wire passes through the module insulating material.

8. The refrigerator of claim 6, wherein the cooling module comprises a cooling fan configured to cool the machine room, and the second wire electrically connects the cooling fan to the electrical box.

9. The refrigerator of claim 1, wherein the electronic device comprises at least one of a dispenser, an ice maker, a display apparatus, and an interior light.

10. The refrigerator of claim 1, wherein the cabinet comprises an electrical box heat dissipation opening formed therein and configured to allow the electrical box to be exposed to outside of the cabinet to dissipate the heat of the electrical box.

11. The refrigerator of claim 2, wherein the module body comprises a connector receiving space formed to receive connectors provided in a plurality of wires extending from the electrical box.

12. The refrigerator of claim 1, wherein the electrical box comprises a test connector configured to electrically connect an external test device to the electrical box.

13. The refrigerator of claim 1, wherein the electrical box comprises a power board configured to receive the power from the external power source and transmit the received power to the electronic device and the compressor and a control board configured to control the electronic device and the compressor by receiving the power from the power board.

14. The refrigerator of claim 1, wherein the cooling module comprises a temperature sensor configured to measure a temperature of cold air generated by the evaporator.

15. The refrigerator of claim 1, wherein the electrical box is arranged in the cabinet.

16. A refrigerator comprising:

a cabinet including:

a first compartment; and a second compartment;

a plurality of cold air ducts connected to the first compartment and the second compartment;

an electronic device arranged in the cabinet;

a cooling module attachable to or detachable from a rear side of the cabinet so that the cooling module is removably mountable to the cabinet, and to respectively supply cold air to the first compartment and the second compartments through the plurality of cold air ducts, the cooling module comprising:

a module body comprising:

a first receiving portion; and a second receiving portion;

a partition wall between the first receiving portion and the second receiving portion to separate the first receiving portion and the second receiving portion, the partition wall comprising a connection duct formed by penetrating the partition wall to communicate the first receiving portion and the second receiving portion;

a first duct module to be accommodated in the first receiving portion, the first duct module comprising:

a first fan; and a first fan connection port formed therein;

a second duct module to be accommodated in the second receiving portion, the second duct module comprising:

a second fan; and a second fan connection port formed therein, to be connected to the first fan connection port;

a compressor;

a condenser;

an expansion valve;

an evaporator comprising:

a first evaporator to connect via the first duct module with the first compartment; and a second evaporator to connect via the second duct module with the second compartment; and an electrical box electrically connected to the electronic device, the electrical box comprising a power board configured to receive power from an external power source and transmit the received power to the electronic device and the compressor, wherein in response to attaching the cooling module to the rear side of cabinet, the first duct module and the second duct module are connected to the plurality of cold air ducts to supply the cold air generated from the first evaporator and the second evaporator to the first compartment and the second compartment, respectively, through the connected plurality of cold air ducts, and in response to detaching the cooling module from the rear side of the cabinet, the first duct module and the second duct module are disconnected from the plurality of cold air ducts and the electrical box is disconnected from the electronic device, and wherein the first fan connection port and the second fan connection port are communicated through the connection duct so that the cold air discharged from the first duct module is introduced into the second duct module through the connection duct.

17. The refrigerator of claim 16, wherein the cooling module comprises a module body, and the module body comprises an electrical box mounting portion to which the electrical box is mounted, a receiving portion in which the evaporator is arranged, and a machine room in which the compressor and the condenser are arranged.

18. The refrigerator of claim 17, wherein the module body comprises a receiving portion opening formed therein and configured to guide a first wire extending to the receiving portion, and a machine room opening configured to guide a second wire extending to the machine room.

19. The refrigerator of claim 18, wherein a module insulating material is provided inside the module body, and the first wire is arranged in such a way that a portion of the first wire passes through the module insulating material, and the second wire is arranged so that a portion of the second wire passes through the module insulating material.

20. The refrigerator of claim 16, wherein the cooling module comprises a test connector configured to electrically connect an external test device to the electrical box, and exposed to outside of the cooling module and a temperature sensor configured to measure a temperature of cold air generated by the evaporator and configured to transmit information on the measured temperature to the electrical box.

* * * * *